US005433261A

United States Patent [19]

Hinton et al.

[11] Patent Number: 5,433,261

[45] Date of Patent: Jul. 18, 1995

[54] METHODS FOR FABRICATING SHAPES BY USE OF ORGANOMETALLIC, CERAMIC PRECURSOR BINDERS

[75] Inventors: Jonathan W. Hinton, Newark; Alexander Lukacs, III, Wilmington; James A. Jensen, Hockessin; Marc S. Newkirk; Michael K. Aghajanian, both of Newark; Ratnesh K. Dwivedi, Wilmington, all of Del.

[73] Assignee: Lanxide Technology Company, LP, Newark, Del.

[21] Appl. No.: 121,814

[22] Filed: Sep. 15, 1993

Related U.S. Application Data

[63] Continuation-in-part of Ser. No. 55,654, Apr. 30, 1993.

[51] Int. Cl.[6] ..... B22D 19/14

[52] U.S. Cl. ..... 164/98; 164/100; 164/75

[58] Field of Search ..... 164/97, 525, 526, 527, 164/528, 75, 98, 100

[56] References Cited

U.S. PATENT DOCUMENTS

| | | | |
|---|---|---|---|
| 2,492,763 | 12/1949 | Pinkney | 260/144 |
| 2,515,628 | 7/1950 | Castle | 260/192 |
| 2,970,982 | 2/1961 | Bluestein | 260/46.5 |
| 3,093,494 | 6/1963 | Hedlund et al. | 106/38.2 |
| 3,432,312 | 3/1969 | Feagin | 106/38.3 |
| 3,898,090 | 8/1975 | Clark | 106/38.2 |
| 4,076,685 | 2/1978 | Kögler | 260/42.53 |
| 4,357,165 | 11/1982 | Helferich et al. | 106/38.3 |
| 4,526,219 | 7/1985 | Dunnavant | 164/525 |
| 4,602,069 | 7/1986 | Dunnavant | 164/525 |
| 4,775,704 | 10/1988 | Nagahori et al. | 523/143 |
| 4,894,254 | 1/1990 | Nakayama | 427/38 |
| 4,929,704 | 5/1990 | Schwark | 528/28 |
| 5,021,533 | 6/1991 | Schwark | 528/21 |
| 5,138,014 | 8/1992 | Katano et al. | 528/29 |
| 5,167,271 | 12/1992 | Lange et al. | 164/98 |
| 5,183,096 | 2/1993 | Cook | 164/98 |

*Primary Examiner*—P. Austin Bradley
*Assistant Examiner*—Jeffrey T. Knapp
*Attorney, Agent, or Firm*—Mark G. Mortenson; Carol A. Lewis

[57] ABSTRACT

Organometallic ceramic precursor binders are used to fabricate shaped bodies by different techniques. Exemplary shape making techniques which utilize hardenable, liquid, organometallic, ceramic precursor binders include the fabrication of negatives of parts to be made (e.g., sand molds and sand cores for metalcasting, etc.), as well as utilizing ceramic precursor binders to make shapes directly (e.g., brake shoes, brake pads, clutch parts, grinding wheels, polymer concrete, refractory patches and liners, etc.). A preferred embodiment of the invention involves the fabrication of preforms used in the formation of composite articles.

20 Claims, 1 Drawing Sheet

METHODS FOR FABRICATING SHAPES BY USE OF ORGANOMETALLIC, CERAMIC PRECURSOR BINDERS

This application is a continuation-in-part application of U.S. Ser. No. 08/055,654, filed Apr. 30, 1993.

FIELD OF THE INVENTION

This invention relates to the discovery of organometallic ceramic precursor binders used to fabricate shaped bodies by different techniques. Exemplary shape making techniques which utilize hardenable, liquid, organometallic, ceramic precursor binders include the fabrication of negatives of parts to be made (e.g., sand molds and sand cores for metalcasting, etc.), as well as utilizing ceramic precursor binders to make shapes directly (e.g., brake shoes, brake pads, clutch parts, grinding wheels, polymer concrete, refractory patches and liners, etc.). In a preferred embodiment, this invention relates to thermosettable, liquid ceramic precursors which provide suitable-strength sand molds and sand cores at very low binder levels and which, upon exposure to molten metalcasting exhibit low emissions toxicity as a result of their high char yields of ceramic upon exposure to heat. Another preferred embodiment of the invention involves the fabrication of preforms used in the formation of composite articles.

BACKGROUND OF THE INVENTION

The casting of metal articles using sand molds, sand shells and sand cores is well known in the art. Detailed information regarding the state of this technology can be found, for example, in a text by James P. LaRue, EdD, Basic Metalcasting (The American Foundrymen's Society, Inc., Des Plaines, Ill., 1989). Using such a technique, a mold can be made from a mixture of sand and (typically) an organic binder by packing the mixture loosely or tightly around a pattern. The pattern is then removed, leaving a cavity in the sand which replicates the shape of the pattern. Once the organic binder is shape-stabilized by any of a number of hardening techniques (as described below), the cavities in the sand mold are filled with molten metal by pouring the molten metal into the mold.

In a typical shell molding operation, binder-coated sand can be blown onto the interior surface of a heated metal pattern. In a relatively short time (20–30 seconds) the heat from the pattern penetrates the sand, producing a bond in the heat-affected layer. This layer clings to the pattern, and when the pattern is rotated, the sand not affected by the heat falls into a hopper for further use. The thin, bonded layer of binder-coated sand clinging to the pattern is then cured by heating. The cured shell is then pushed from the pattern by ejector pins. When a mating shell is produced, the shells are aligned and fastened together with a high-temperature adhesive for pouring.

Just as the sand mold cavity provides the external shape of a casting, any holes or other internal shapes in a casting can be produced by using sand cores. When such cores are made from sand, numerous acceptable processes for making these cores are acceptable. In most cases, a sand mixture comprising a binder material is placed into a corebox. There, the sand mixture takes the shape of the cavity in the box, becomes hard, and is removed. After the mold is made, the core is then set in the "drag" just before the mold is closed. When the metal is poured, the molten metal fills the mold cavity except for where sand cores are present. Thus, the shape of the solidified casting results from the combined shapes of the mold and the sand core(s).

Before 1943, coremaking was simple. There was one core process, known as oil-sand, which had been used for many years. Since then, there has been a dramatic increase in coremaking technology. At present there are at least 21 different coremaking systems. Over 160 binder materials are now available for making cores. These binder materials can be categorized as vapor-cured (cured by a gas of some kind), heat-cured (cured by heat), or no-bake (cured by chemical reaction).

While it is not the intent of this disclosure to discuss all of the various binders which are currently in use for such processes, perhaps the most commonly utilized binders comprise both inorganic and organic resins.

In the realm of inorganic systems, both vapor-cured and no-bake sodium silicate binders are known. No-bake, oxide-cured phosphate binders are also available. Such inorganic binders often have low emissions resulting from their high char forming characteristics. The term "char" should be understood as meaning the solid products of binder decomposition which remain after thermal treatment during the metalcasting process. They do, however, have certain disadvantages.

Vapor-cured sodium silicate binders, for example, are typically processed by coating sand grains with the sodium silicate binder, backing the mixture into a corebox, and then gassing the mixture in the corebox with carbon dioxide for a short period of time (about 10 seconds). This treatment hardens the core, allowing it to be removed from the corebox. One advantage of this system is that the core can be used immediately. A major disadvantage of such systems, however, is the tendency for the resulting cores to absorb moisture. Many of the inorganic resin systems currently in use share this problem.

By far, the largest number of sand binders which are used in the art of metalcasting are organic resins. Vapor-cured systems include the phenolic urethane/amine binders, phenolic esters, furan/peroxide systems which, typically, are acid cured, and epoxy/sulfur dioxide systems. Heat-cured systems include phenolic resins, furan systems, and urea formaldehyde binders. No-bake systems comprise acid-cured furan systems, acid-cured phenolic resins, alkyd oil urethanes, phenolic urethanes, and phenolic esters. While these wholly organic systems often offer flexibility in processing (e.g., these systems can be solvent processed, melted, etc.), the hardened molds or cores produced using such binders have very serious drawbacks including, for example, the evolution of toxic emissions during the metal casting process due to the low char yield characteristics of organic resins.

Additionally, when such binders are used to bond particles together to make shapes directly, similar problems to those discussed above also result. For example, similar problems can occur when making brake shoes, brake pads, clutch parts, gravity wheels, polymer concrete, refractory patches, liners, preforms of various components for further processing, etc.

Organometallic, ceramic precursors are known in the art of ceramic processing. These materials can be in the form of either solvent-soluble solids, meltable solids, or hardenable liquids, all of which permit the processibility of their organic counterparts in the fabrication of ceramic "green bodies". During the sintering of such green parts, however, the ceramic precursor binders have the added advantage of contributing to the overall ceramic content of the finished part, because the thermal decomposition of such ceramic precursor binders results in relatively high yields of ceramic "char". Thus, most of the precursor is retained in the finished part as ceramic material, and very little mass is evolved as undesirable volatiles. This second feature is advantageous, for example, in reducing part shrinkage and the amount of voids present in the fired part, thereby reducing the number of critically sized flaws which have been shown to result in strength degradation of formed bodies.

Such precursors can be monomeric, oligomeric, or polymeric and can be characterized generally by their processing flexibility and high char yields of ceramic material upon thermal decomposition (i.e. pyrolysis). These precursors are neither wholly inorganic nor wholly organic materials, since they comprise metal-carbon bonds. These precursors can be distinguished from other known inorganic binders for sand mold fabrication described above (which comprise no carbon), and other known organic binders (which comprise no metallic elements). It has been unexpectedly discovered that such organometallic "hybrids" which are hardenable liquids are uniquely suited for use as binders for sand grains in the fabrication of sand molds, cores, and shells, since they can provide excellent mold strength at extremely low binder levels. Their utility resides in a unique combination of, for example, the processing flexibility afforded by organic binders and the high char forming characteristics and improved adhesion to sand of inorganic binders. Such binders can therefore be easily processed to provide a hardened sand mold, and subsequently used for metalcasting with a minimum of toxic volatiles being evolved. Further, it has been unexpectedly discovered that such organometallic "hybrids" are uniquely suited for use as binders for filler materials in the fabrication of preforms to be used in the formation of composite materials. For example, such organometallic "hybrids" have been found to be uniquely suited to the formation of metal matrix composites by molten metal infiltration processes (e.g., spontaneous infiltration, pressure and vacuum assisted infiltration, etc.). Moreover, these organometallic "hybrids" have also been found to be useful as preform binders for ceramic matrix composite formation processes (e.g., directed metal oxidation, sintering, isostatic pressing, chemical vapor infiltration, etc.). Further, since such organometallic, ceramic precursor binders are also liquids, they can be employed directly without use of a solvent. This obviates the emissions and disposal problems associated with solvent-based systems which require a "drying" step subsequent to mold shaping.

Siloxanes have been used in the past to improve the adhesion of such binder systems as polycyanoacrylates to sand grains (see, for example, U.S. Pat. No. 4,076,685). In such a system the siloxane is used as a processing aid rather than the binder itself. Additionally, partial condensates of trisilanols have been used in combination with silica as binder systems which are provided in aliphatic alcohol-water cosolvent (see, for example, U.S. Pat. No. 3,898,090). Such in-solvent binders have been shown to suffer the disadvantage of short shelf life ("several days") due to additional silanol condensation during storage. A further disadvantage is that these binders require the step of solvent removal from the core or mold by a drying process ("to remove a major portion of the alcohol-water cosolvent") before metalcasting. Otherwise, voids and poor mold integrity result during the metalcasting process. The use of hardenable, liquid organometallic, ceramic precursors as solventless binders for the fabrication of sand molds, shells, and cores has not been disclosed.

SUMMARY OF THE INVENTION

This invention relates to the discovery of organometallic ceramic precursor binders used to fabricate shaped bodies by different techniques. Exemplary shape making techniques which utilize hardenable, liquid, organometallic, ceramic precursor binders include the fabrication of negatives of parts to be made (e.g., sand molds and sand cores for metalcasting, etc.), as well as utilizing ceramic precursor binders to make shapes directly (e.g., brake shoes, brake pads, clutch parts, grinding wheels, polymer concrete, refractory patches, liners, and preforms of various components for further processing, etc.).

A preferred embodiment of the invention relates to the fabrication of shaped metal, or metal matrix composite, articles by metalcasting into sand molds, shells or sand cores prepared using hardenable, liquid, organometallic, ceramic precursor binders. In this preferred embodiment, the method comprises (1) solventless coating of the surface of sand with a hardenable, liquid, organometallic, ceramic precursor binder, (2) forming a shape from said sand/binder mixture, (3) hardening said binder to form a sand mold, shell, or core, and (4) metalcasting into the resulting hardened sand mold, shell, or core to form a shaped metal article.

It has been discovered that such solventless binder compositions can be used at very low binder levels since (1) such binders can be made to be liquids and provide for excellent sand grain surface wetting, and (2) the binders are provided without solvent. Surprisingly, binder levels as low as 0.1 wt % of a polyureasilazane comprising crosslinkable vinyl groups result in sand molds which have excellent strength in metalcasting operations.

In a typical process according to a preferred embodiment of the invention, a predetermined quantity of sand is coated by mixing the sand with an organometallic, ceramic precursor binder in an amount sufficient to result in a hardened sand mold, shell, or core having suitable strength for ease of handling, as well as sufficient structural integrity needed for the metalcasting process. However, the aforementioned sufficient strength should not be too great so as to deleteriously impact the ability to remove a cast metal part from a sand mold (e.g., by physically breaking the sand mold away from the cast part).

The sand/binder mixture is then shaped using standard procedures for preparing metalcasting molds, shells, or cores and then hardened using a procedure suited to the exact chemical composition of the organometallic, ceramic precursor binder.

The hardened mold, shell, or core is then used to pour a shaped metal object by a metalcasting process. It should be understood that while this disclosure refers primarily to a metalcasting process, the concepts of this disclosure also apply to the casting of metal matrix composite articles.

Another preferred embodiment of the invention relates to the use of organometallic ceramic precursor binders in the fabrication of preforms used in the formation of composite articles, such as ceramic composite articles and metal matrix composite articles.

In a particularly preferred embodiment for forming metal matrix composite bodies, such organometallic ceramic precursor binders may be used to form preforms to be used in the fabrication of metal matrix composite articles by a pressureless metal infiltration process described, for example, in commonly owned U.S. Pat. No. 5,249,621, which issued Oct. 5, 1993, in the names of Aghajanian et al. and entitled "Method of Forming Metal Matrix Composite Bodies by a Spontaneous Infiltration Process and Products Produced Therefrom" from U.S. patent application Ser. No. 07/863,894, filed Apr. 6, 1992, which is a continuation application of U.S. patent application Ser. No. 07/521,043, filed May 9, 1990, and now abandoned, which in turn is a continuation-in-part application of U.S. Ser. No. 07/484,753, filed Feb. 23, 1990, and now abandoned, which in turn is a continuation-in-part application of U.S. Ser. No. 07/432,661, filed Nov. 7, 1989, and now abandoned, which in turn is a continuation-in-part application of U.S. patent application Ser. No. 07/416,327, filed Oct. 6, 1989, and now abandoned, which in turn is a continuation-in-part application of U.S. patent application Ser. No. 07/349,590, filed May 9, 1989, and now abandoned, which in turn is a continuation-in-part application of U.S. patent application Ser. No. 07/269,311, filed Nov. 10, 1988, and now abandoned. The entire subject matter of the above-identified patent and patent applications is herein expressly incorporated by reference. In this preferred embodiment, the method comprises (1) providing a solventless coating on at least a portion of the surface of a filler material with a hardenably liquid, organometallic, ceramic precursor binder, (2) optionally incorporating an infiltration enhancer and/or an infiltration enhancer precursor with the solventless coated filler material, (3) forming a shape from the filler material/binder mixture, optionally containing an infiltration enhancer precursor and/or an infiltration enhancer, (4) hardening said binder to form a permeable preform, and (5) spontaneously infiltrating the resulting permeable preform using the methods described in commonly owned U.S. Pat. No. 5,249,621 to form a shaped metal article.

It has been discovered that such solventless binder composition can be used at very low levels since (1) such binders can be made to be liquids and provide for excellent filler material surface wetting and (2) the binders are provided without solvent. Surprisingly, binder levels as low as 0.1 weight percent of a polyureasilazane comprising crosslinkable vinyl groups result in preforms which have excellent strength for use in the pressureless metal infiltration process. For example, when an infiltration enhancer or an infiltration enhancer precursor is used in combination with the filler material, binder levels from about 0.5 weight percent to about 3 weight percent of a polyureasilazane may be used.

In a typical process according to a preferred embodiment of the invention, a predetermined quantity of filler material is coated by mixing the filler material with an organometallic, ceramic precursor binder in an amount sufficient to result in a hardened preform having suitable strength for ease of handling, as well as sufficient structural integrity needed for the pressureless metal infiltration process.

The hardened preform is then used in the pressureless metal infiltration process to form the metal matrix composite article. It should be understood that while the present disclosure refers primarily to forming metal matrix composite bodies by the pressureless metal infiltration process, the concept of this disclosure also applies to formation of metal matrix composite articles by, for example, pressure infiltration, vacuum-assisted infiltration, etc.

DETAILED DESCRIPTION OF THE INVENTION

Figure 1:
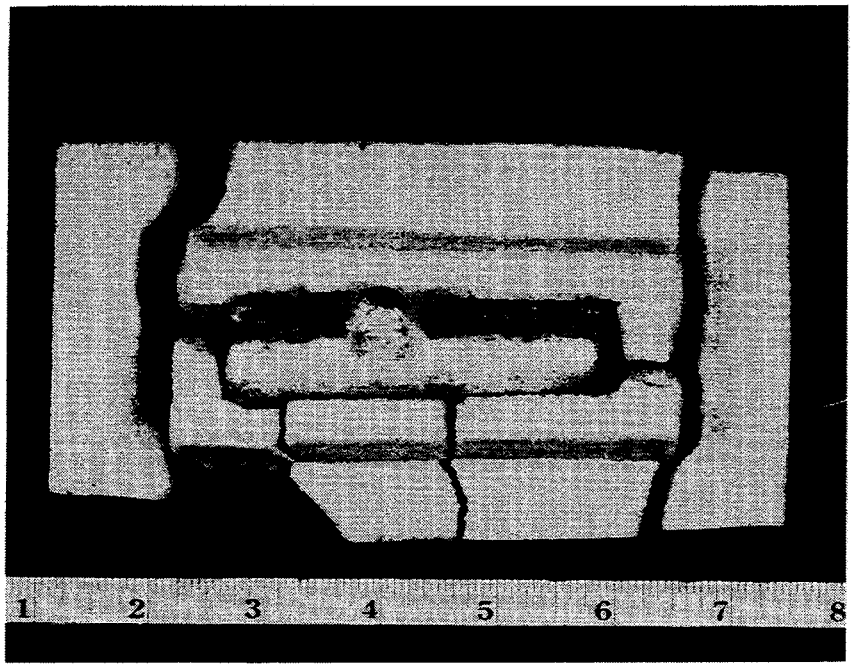
FIG. 1 is a photograph of the cast aluminum alloy piece and the sand mold formed in Example 5.

This invention relates to the discovery of organometallic ceramic precursor binders used to fabricate shaped bodies by different techniques. Exemplary shape making techniques which utilize hardenable, liquid, organometallic, ceramic precursor binders include the fabrication of negatives of parts to be made (e.g., sand molds and sand cores for metalcasting, etc.), as well as utilizing ceramic precursor binders to make shapes directly (e.g., brake shoes, brake pads, clutch parts, grinding wheels, polymer concrete, refractory patches, liners, and preforms for various components for further processing, etc.).

The organometallic, ceramic precursor binders suitable for the practice of this invention include monomers, oligomers and polymers. The term "organometallic" should be understood as meaning a composition comprising a metal-carbon bond. Suitable metals include both main group and transition metals selected from the group consisting of metals and metalloids selected from IUPAC groups 1 through 15 of the periodic table of elements inclusive. Preferred metals/metalloids include titanium, zirconium, silicon and aluminum, with silicon being a preferred selection.

While monomeric ceramic precursors can satisfy the requirements necessary for the practice of this invention, monomers that polymerize to form hard polymers of appreciable ceramic yield (e.g., greater than 20 percent by weight) often have so low a molecular weight that volatilization at modest molding temperatures becomes a problem. One example of this is vinyltrimethylsilane, which has a boiling point of only 55° C. Curing this monomer by thermal or radical means to form a hardened binder requires temperatures greater than the boiling point of the monomer. It is thus unsuitable in the process described. Because monomers are generally too volatile to be used in this molding process, the preferred liquid ceramic precursors of this invention are either oligomeric or polymeric. An oligomer is defined as a polymer molecule consisting of only a few monomer repeat units (e.g., greater than two and generally less than 30) while a polymer has monomer repeat units in excess of 30. Suitable polymers include, for example, but should not be construed as being limited to polysilazanes, polyureasilazanes, polythioureasilazanes, polycarbosilanes, polysilanes, polysiloxanes, polyborosilazanes, polyaminosilazanes and polyaminoboranes. Precursors to oxide ceramics such as aluminum oxide as well as non-oxide ceramics can also be used. Organometallic, ceramic precursors suitable for the practice of this invention should have char yields in excess of 20 percent by weight, preferably in excess of 40 percent by weight, and more preferably in excess of 50 percent by weight when the hardened precursor is thermally decomposed.

The organometallic, ceramic precursors suitable for the practice of this invention preferably contain sites of organounsaturation such as alkenyl, alkynyl, epoxy, acrylate or methacrylate groups. Such groups may facilitate hardening when energy in the form of heat, UV irradiation, or laser energy is provided to promote a free radical or ionic crosslinking mechanism or the organounsaturated groups. Such crosslinking reactions promote rapid hardening and result in hardened binders having higher ceramic yields upon pyrolysis. High ceramic yield typically results in lower volatiles evolution during metalcasting. Specific examples of such precursors include poly(acryloxypropylmethyl)siloxane, glycidoxypropylmethyldimethylsiloxane copolymer, polyvinylmethylsiloxane, poly(methylvinyl)silazane, 1,2,5-trimethyl-1,3,5-trivinyltrisilazane, 1,3,5,7-tetramethyl-1,3,5,7-tetravinyltetrasilazane, 1,3,5-tetravinyltetramethylcyclotetrasiloxane, tris(vinyldimethylsiloxy)methylsilane, and trivinylmethylsilane.

When heat is provided as the source of energy, a free radical generator, such as a peroxide or azo compound, may, optionally, be added to promote rapid hardening at a low temperature.

Exemplary peroxides for use in the present invention include, for example, diaroyl peroxides such as dibenzoyl peroxide, di p-chlorobenzoyl peroxide, and bis-2,4-dichlorobenzoyl peroxide; dialkyl peroxides such as 2,5-dimethyl-2,5-di(t-butylperoxy)hexane and di t-butyl peroxide; diaralkyl peroxides such as dicumyl peroxide; alkyl aralkyl peroxides such as t-butyl cumyl peroxide and 1,4-bis(t-butylperoxyisopropyl)benzene; alkylaroyl peroxides and alkylacyl peroxides such as t-butyl perbenzoate, t-butyl peracetate, and t-butyl peroctoate. It is also possible to use peroxysiloxanes as described, for example, in U.S. Pat. No. 2,970,982 (the subject matter of which is herein incorporated by reference) and peroxycarbonates such as t-butylperoxy isopropyl carbonate.

Symmetrical or unsymmetrical azo compounds, such as the following, may be used as free radical generators: 2,2'-azobis(2-methylpropionitrile); 2,2'-azobis(2,4-dimethyl-4-methoxyvaleronitrile); 1-cyano-1-(t-butylazo)cyclohexane; and 2-(t-butylazo)isobutyronitrile. These products are well known and are described, for example, in U.S. Pat. Nos. 2,492,763 and 2,515,628 (the subject matter of which is herein incorporated by reference).

In addition to crosslinking which may be provided through sites of organounsaturation which are appended to the organometallic, ceramic precursor binder, additional modes of crosslinking provided by polymer chain condensation upon pyrolysis may be beneficial. Thus, for example, silicon polymers comprising nitrogen are preferred to silicon polymers comprising oxygen, since nitrogen is trivalent. In polysilazanes, for instance, the repeat unit of the polymer chain contains Si—N bonds in which the nitrogen atom is then further bonded both to either two addition silicon atoms, or a silicon atom and a carbon or hydrogen atom. Upon thermal treatment, such polysilazanes crosslink via N—C or N—H bond cleavage with subsequent crosslinking provided by formation of an additional Si—N bond. Such crosslinking provides for higher char yields upon binder hardening. This leads to lower volatiles evolution during metalcasting when such polymers are used as binders for the sand mold, shells, or cores which are used.

The known method of coating the sand with the liquid, organometallic, ceramic precursor can be used. Such methods comprise, but are not limited to simple hand mixing, mulling, milling, etc.

In the formation of molds for casting, the amount of organometallic, ceramic precursor binder used in coating should be such that the strength of the hardened, molded sand object is sufficient to provide for easy handling and also sufficient to ensure structural integrity of the mold during the metalcasting process. Similarly, the amount of organometallic, ceramic precursor binder utilized in the formation of preforms for composite article fabrication should allow for ease of handling and sufficient structural integrity during the composite formation process. Surprisingly, when suitable organometallic ceramic precursors are used such binder levels can be quite low. While binder levels can be in the range of 0.1% to about 20% based on the total weight of the sand/binder mixture or the filler material/binder mixture, preferably 0.1 wt % to 5 wt %, and more preferably 0.1 wt % to 2 wt % of binder should be used. When highly crosslinkable organometallic, ceramic precursor binders are used, the lowest levels of binder can be achieved.

While not wishing to be bound by any particular theory or explanation, it is believed that the unique suitability of such organic/inorganic "hybrid" systems derives from their ability to provide the processing flexibility and hardened strength of organic resin binders with the sand surface-compatibility of inorganic binder systems. Such sand surface-compatibility is described in, for example, U.S. Pat. No. 4,076,685 (the subject matter of which is herein incorporated by reference), wherein a siloxane is used to promote adhesion of a thermoplastic cyanoacrylate polymer binder to sand grains.

Once formulated, the sand/binder mixture can be formed into molds, shells, or cores by any technique known in the art. Binder hardening is then accomplished by vapor arc, heat arc, chemical cure and/or combinations thereof.

In a preferred embodiment, the organometallic ceramic precursor binder comprises a site of organounsaturation such as a vinyl group which can be crosslinked by thermal treatment to harden the binder. When such compositions are used, a free radical initiator can be added to the composition to facilitate the free radical crosslinking of the binder which serves to harden irreversibly the composition. When a free radical generator is used, a temperature is generally selected so that the hardening time is greater or equal to one or preferably two half lives of the initiator at that temperature. It is important for the sand/binder mixture to harden sufficiently so that ease of handling and metalcasting can be ensured. Likewise, it is important that the filler material/binder mixture hardens sufficiently so that ease of handling the preform in preparing for and during composite formation can be insured. Suitable free radical initiators include, but are not limited to, organic peroxides, inorganic peroxides, and azo compounds.

Once the binder is hardened, the sand molds, shells, and cores can then be used for metalcasting. Typical metals suitable for such application include aluminum, aluminum alloys, iron, ferrous alloys and composites including such metals as the matrix.

Another preferred embodiment of the invention relates to the use of organometallic ceramic precursor binders in the fabrication of preforms used in the formation of composite articles, and particularly metal matrix composite articles made by the pressureless metal infiltration process described in, for example, commonly owned U.S. Pat. No. 5,249,621, which issued Oct. 5, 1993, in the names of Aghajanian et al. and entitled "Method of Forming Metal Matrix Composite Bodies by a Spontaneous Infiltration Process and Products Produced Therefrom" from U.S. patent application Ser. No. 07/863,894, filed Apr. 6, 1992, which is a continuation application of U.S. patent application Ser. No. 07/521,043, filed May 9, 1990, and now abandoned, which in turn is a continuation-in-part application of U.S. Ser. No. 07/484,753, filed Feb. 23, 1990, and now abandoned, which in turn is a continuation-in-part application of U.S. Ser. No. 07/432,661, filed Nov. 7, 1989, and now abandoned, which in turn is a continuation-in-part application of U.S. patent application Ser. No. 07/416,327, filed Oct. 6, 1989, and now abandoned, which in turn is a continuation-in-part application of U.S. patent application Ser. No. 07/349,590, filed May 9, 1989, and now abandoned, which in turn is a continuation-in-part application of U.S. patent application Ser. No. 07/269,311, filed Nov. 10, 1988, and now abandoned. The entire subject matter of the above-identified patent and patent applications is herein expressly incorporated by reference.

In this preferred embodiment, the method for forming a metal matrix composite comprises (1) providing a solventless coating on the surface of a filler material with a hardenable liquid, organometallic, ceramic precursor binder, (2) optionally incorporating an infiltration enhancer and/or an infiltration enhancer precursor with the solventless coated filler material, (3) forming a shape from the filler material/binder mixture, (4) hardening said binder to form a preform, and (5) spontaneously infiltrating the resulting preform using the methods described in U.S. Pat. No. 5,249,621 to form a shaped metal matrix article.

It has been discovered that such solventless binder composition can be used at very low levels since (1) such binders can be made to be liquids and provide for excellent filler material surface wetting and (2) the binders are provided without solvent. Surprisingly, binder levels as low as 0.1 weight percent of a polyureasilazane comprising crosslinkable vinyl groups result in preforms which have excellent strength for use in the pressureless metal infiltration process. When an infiltration enhancer or an infiltration enhancer precursor is used in combination with the filler material, binder levels from about 0.5 weight percent to about 3 weight percent of a polyureasilazance may be used.

In a typical process according to a preferred embodiment of the invention, a predetermined quantity of filler material is coated by mixing the filler material with an organometallic, ceramic precursor binder in an amount sufficient to result in a hardened preform having suitable strength for ease of handling, as well as sufficient structural integrity needed for the pressureless metal infiltration process.

The hardened preform is then used in the pressureless metal infiltration process to form the metal matrix composite article. It should be understood that while this disclosure refers primarily to forming metal matrix composite bodies by the pressureless metal infiltration process, the concept of this disclosure also applied to formation of metal matrix composite articles by, for example, pressure infiltration, vacuum-assisted infiltration, etc.

The following non-limiting examples are provided to illustrate the use of polysilazane and polysiloxane ceramic precursor binders in the preparation of sand molds and sand cores for the metalcasting of aluminum/silicon alloy and iron.

EXAMPLE 1

This Example demonstrates a method for fabricating a sand mold for metalcasting using a Polyureasilazane in accordance with the present invention.

An about 8.0 gram sample of a polyureasilazane prepared as described in U.S. Pat. No. 4,929,704, Example 4, was combined with about 5.0 percent by weight dicumyl peroxide. Washed silica sand (about 192 gram, Wedron Silica Co., Wedron, Ill.) was hand mixed into the polymer/peroxide blend to give a "wet" sand consistency with a polymer loading level of about 4 weight percent. An about 20 gram sample of the polymer/sand mixture was loaded into a conically shaped crucible and compacted. The crucible was heated to about 120° C. for a period of about 1 hour, the temperature was raised to about 130° C. and the crucible was held at this temperature for about 1 hour, and the temperature was then raised to about 140° C. for about 0.5 hour. The vessel was allowed to cool to room temperature. The polymer/sand mixture had hardened in the crucible, and replicated the exact shape of the crucible. The molded piece could be sanded to a new shape by rubbing with coarse silicon carbide abrasive cloth. The hardened 4 percent by weight part could be dropped or thrown against a table top without visible damage.

EXAMPLE 2

This Example demonstrates the use of differing binder amounts in a sand mold fabricated in accordance with the present invention.

In the same manner as Example 1, polymer sand mixtures were prepared at the 0.5 percent by weight and 1 percent by weight polymer levels. About 20 gram samples were loaded into crucibles and cured according to the heating schedule of Example 1. The following observations were noted. The cured 1.0 percent by weight part could be dropped or thrown onto the table top with only slight visible edge damage. The 0.5 percent by weight cured part could be crumbled by hand using considerable effort.

EXAMPLE 3

This Example demonstrates a method for fabricating a sand mold for metalcasting using a Polysilazane in accordance with the present invention. Substantially the same procedure used in Example 1 was used to prepare a hardened part comprising 4 percent by weight poly(methylvinyl)silazane binder prepared by the ammonolysis of an 80:20 molar ratio mixture of methyldichlorosilane to vinylmethyldichlorosilane in hexane solvent according to procedures detailed in Example 1 of U.S. Pat. No. 4,929,704. The part could be dropped or thrown against a table top without visible damage.

EXAMPLE 4

This Example demonstrates a method for fabricating a sand mold for metal casting in accordance with the present invention.

Dicumyl peroxide (about 1.2 gram) was dissolved in the polyureasilazane polymer described in Example 1 (about 24 grams). Washed silica sand (about 1176 grams, Wedron Silica Co., Wedron, Ill.) was slowly mixed into the polymer/peroxide blend to form an about 2 percent by weight polymer/sand mixture. This 2 percent by weight binder/sand mixture was packed into a rubber mold containing a positive definition well for metal casting. The binder/sand mixture was cured in an air atmosphere oven at about 100° C. for a period of about 30 minutes, the temperature was raised to about 110° C. for about 1 hour, and then raised to about 125° C. for about 1 hour. The mold was cooled to room temperature and the sand was demolded. The sand replicated the shape of the mold.

EXAMPLE 5

This Example demonstrates a method for fabricating a sand mold for metal casting and thereafter casting molten aluminum alloy into the cavity of the sand mold.

Dicumyl peroxide (about 0.6 gram) was dissolved in the polyureasilazane polymer described in Example 1 (about 12 grams). Washed silica sand (about 1176 grams, Wedron Silica Co., Wedron, Ill.) was slowly mixed into the polymer/peroxide blend to form a 1 percent by weight polymer/sand mixture. This 1 percent by weight binder/sand mixture was packed into a rubber mold containing a positive definition well for metal casting. The binder/sand mixture was cured in an air atmosphere oven at about 100° C. for a period of about 30 minutes, the temperature was raised to about 110° C. for about 1 hour, and then raised to about 125° C. for about 1 hour. The mold was cooled to room temperature and the sand was demolded. The sand replicated the shape of the mold.

The cured mold was then placed on a table and an aluminum alloy comprising about 10% silicon by weight, balance aluminum, was melted and raised to a temperature of about 700° C. After stabilizing the temperature of the molten aluminum alloy at about 700° C., a ladle was dipped into the molten aluminum alloy and a small sample of the aluminum alloy was slowly poured into the cavity of the mold and the aluminum alloy was allowed to cool to room temperature.

FIG. 1 is a photograph of the cast aluminum alloy part and the mold.

EXAMPLE 6

This Example demonstrates. a method for fabricating a sand mold for metal casting and thereafter casting molten aluminum alloy around the sand mold.

Dicumyl peroxide (about 1.2 gram) was dissolved in the polyureasilazane polymer described in Example 1 (about 24 grams). Washed silica sand (about 1176 grams, Wedron Silica Co., Wedron, Ill.) was slowly mixed into the polymer/peroxide blend to form a 2 percent by weight polymer/sand mixture. This 2 percent by weight binder/sand mixture was packed into a rubber mold containing a positive definition well for metal casting. The binder/sand mixture was cured in an air atmosphere oven at about 100° C. for a period of about 30 minutes, the temperature was raised to about 110° C. for about 1 hour, and then raised to about 125° C. for about 1 hour. The mold was cooled to room temperature and the sand was demolded. The sand replicated the shape of the mold.

The cured sand mold was placed into a graphite mold having a cavity measuring about 7 inches by 7 inches by 1 inch. An aluminum alloy comprising about 10% by weight silicon, balance aluminum, was melted and maintained at a temperature of about 700° C. A ladle was dipped into the molten aluminum and a small sample of the aluminum alloy was poured into the graphite mold, around the cured sand mold, but not into its cavity, and allowed to cool to room temperature.

EXAMPLE 7

This Example demonstrates a method for fabricating a sand mold for metal casting and thereafter casting molten cast iron into the cavity of the sand mold.

Dicumyl peroxide (about 0.6 gram) was dissolved in the polyureasilazane polymer described in Example 1 (about 12 grams). Washed silica sand (about 1176 grams, Wedron Silica Co., Wedron, Ill.) was slowly mixed into the polymer/peroxide blend to form a 1 percent by weight polymer/sand mixture. This 1 percent by weight binder/sand mixture was packed into a rubber mold containing a positive definition well for metal casting. The binder/sand mixture was cured in an air atmosphere oven at about 100° C. for a period of about 30 minutes, the temperature was raised to about 110° C. for about 1 hour, and then raised to about 125° C. for about 1 hour. The mold was cooled to room temperature and the sand was demolded. The sand replicated the shape of the mold.

Figure 2:
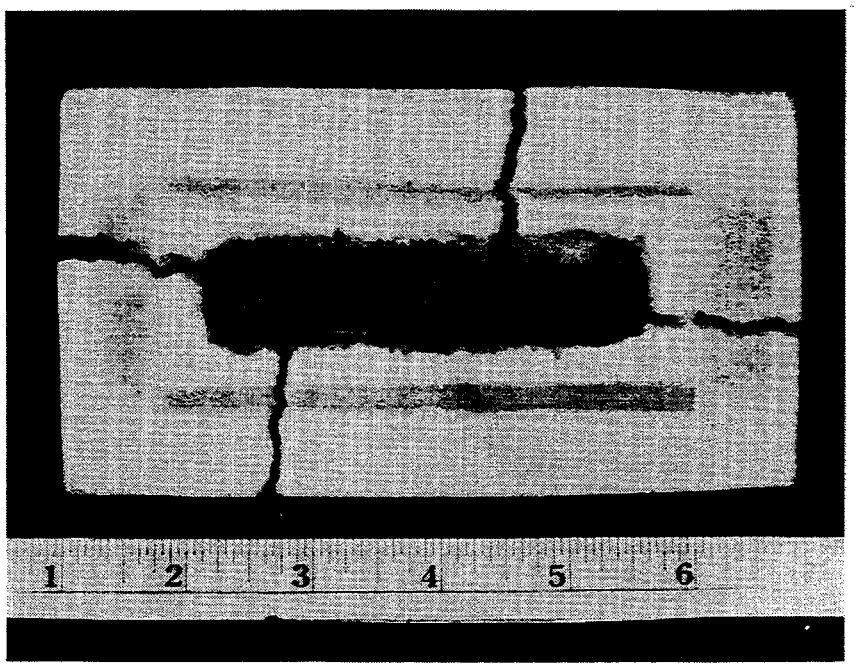
FIG. 2 is a photograph of the cast iron piece and the sand mold formed in Example 7.

A quantity of cast iron was placed into a small crucible and melted and maintained at a temperature of about 1350° C. After maintaining a temperature of about 1350° C., a small amount of the cast iron was poured from the crucible into the center cavity of the cured sand mold and allowed to cool to room temperature. FIG. 2 is a photograph of the cooled cast iron piece and the sand mold.

EXAMPLE 8

This Example demonstrates a method for fabricating a sand mold for metal casting and thereafter casting molten cast iron around the sand mold.

Dicumyl peroxide (about 1.2 grams) was dissolved in the polyureasilazane polymer described in Example 1 (about 24 grams). Washed silica sand (about 1176 grams, Wedron Silica Co., Wedron, Ill.) was slowly mixed into the polymer/peroxide blend to form a 2 percent by weight polymer/sand mixture. This 2 percent by weight binder/sand mixture was packed into a rubber mold containing a positive definition well for metal casting. The binder/sand mixture was cured in an air atmosphere oven at about 100° C. for a period of about 30 minutes, the temperature was raised to about 110° C. for about 1 hour, and then raised to about 125° C. for about 1 hour. The mold was cooled to room temperature and the sand was demolded. The sand replicated the shape of the mold.

The cured sand piece was placed into a steel frame having a cavity of about 6 inches by 5 inches. A quantity of cast iron was melted in a small crucible and maintained at a temperature of about 1350° C. The cast iron was then poured from the crucible into the steel frame and around the cured sand piece, but not into its cavity, and allowed to cool to room temperature.

We claim:

1. A process for fabricating shaped metal matrix composite articles by a spontaneous infiltration process, said process comprising (1) providing a solventless coating on at least a portion of the surface of a filler material with a hardenable, liquid, organometallic, ceramic precursor binder to form a filler material/binder mixture, (2) forming a shape from said filler material/binder mixture, (3) hardening said binder in said filler material/binder mixture to form a permeable preform and (4) spontaneously infiltrating a matrix metal into the permeable preform to form a shaped metal matrix composite article.

2. The process of claim 1, wherein said spontaneous infiltration is accomplished using at least one of an infiltration enhancer and an infiltration enhancer precursor in said filler material.

3. The process of claim 1, wherein the binder is hardened through the application of heat, UV irradiation, or laser energy.

4. The process of claim 3, wherein the binder is hardened through the application of heat.

5. The process of claim 4, where the binder further comprises a free radical generator.

6. The process of claim 5, wherein said free radical generator is a peroxide or an azo compound.

7. The process of claim 6, wherein said peroxide is dicumyl peroxide.

8. The process of claim 1, wherein said hardenable, liquid, organometallic, ceramic precursor comprises oxygen or nitrogen.

9. The process of claim 8, wherein said hardenable, liquid, organometallic, ceramic precursor comprises nitrogen.

10. The process of claim 1, wherein said binder is present to the extent of 0.1% to about 20% based on the total weight of the filler material/binder mixture.

11. The process of claim 10 wherein said binder is present to the extent of 0.1 wt % to 5 wt % based on the total weight of the filler material/binder mixture.

12. The process of claim 11 wherein said binder is present to the extent of 0.1 wt % to 2 wt % based on the total weight of the filler material/binder mixture.

13. The process of claim 1, wherein said hardenable, liquid, organometallic, ceramic precursor comprises an alkenyl, alkynyl, epoxy, acrylate or methacrylate group.

14. The process of claim 13, wherein said hardenable, liquid, organometallic, ceramic precursor comprises an alkenyl group.

15. The process of claim 14, wherein said alkenyl group comprises a vinyl group.

16. The process of claim 1, wherein said hardenable, liquid, organometallic, ceramic precursor comprises titanium, zirconium, aluminum, or silicon.

17. The process of claim 16, wherein said hardenable, liquid, organometallic, ceramic precursor comprises silicon.

18. The process of claim 17, wherein said hardenable, liquid, organometallic, ceramic precursor comprises a polyureasilazane.

19. The process of claim 17, wherein said hardenable, liquid, organometallic, ceramic precursor comprises a polysilazane.

20. The process of claim 17, wherein said hardenable, liquid, organometallic, ceramic precursor comprises a polysiloxane.

* * * * *